US008066134B2

(12) United States Patent
Davidson

(10) Patent No.: US 8,066,134 B2
(45) Date of Patent: Nov. 29, 2011

(54) REINFORCED METAL CASTING

(75) Inventor: Ian Robert Davidson, Darlington (GB)

(73) Assignee: Duraloc Limited, Thirsk (GB)

( * ) Notice: Subject to any disclaimer, the term of this patent is extended or adjusted under 35 U.S.C. 154(b) by 527 days.

(21) Appl. No.: 12/247,384

(22) Filed: Oct. 8, 2008

(65) Prior Publication Data

US 2009/0089981 A1 Apr. 9, 2009

(30) Foreign Application Priority Data

Oct. 8, 2007 (GB) ..... 0719570.4

(51) Int. Cl.
*B65D 88/00* (2006.01)
*B65D 6/28* (2006.01)
*B22D 19/16* (2006.01)

(52) U.S. Cl. ..... 220/1.5; 220/682; 164/98

(58) Field of Classification Search ..... 220/4.34, 220/4.33, 622, 615, 610, 682, 677, 4.01, 220/600; 217/17, 43 R, 13; *B65D 6/28, B65D 6/00; B22D 19/16, 19/02*
See application file for complete search history.

(56) References Cited

U.S. PATENT DOCUMENTS

| | | | | | |
|---|---|---|---|---|---|
| 1,405,150 | A | * | 1/1922 | O'Neill | 217/12 R |
| 2,919,826 | A | * | 1/1960 | Richter | 220/1.5 |
| 3,061,133 | A | * | 10/1962 | Reynolds | 220/1.5 |
| 3,128,897 | A | * | 4/1964 | Wilkins | 220/1.5 |
| 3,456,829 | A | * | 7/1969 | Glassmeyer | 220/1.5 |
| 3,456,830 | A | | 7/1969 | Golder | |
| 3,587,900 | A | * | 6/1971 | Millar et al. | 217/12 R |
| 3,854,620 | A | * | 12/1974 | Saidla | 220/616 |
| 4,291,739 | A | | 9/1981 | Baur | |
| 4,416,385 | A | * | 11/1983 | Clare et al. | 220/1.5 |
| 4,465,041 | A | | 8/1984 | Hayashi | |
| 6,035,923 | A | * | 3/2000 | Oda et al. | 164/97 |
| 2004/0262305 | A1 | * | 12/2004 | Myers | 220/1.5 |

FOREIGN PATENT DOCUMENTS

| | | | |
|---|---|---|---|
| DE | 2533058 | A1 | 7/1975 |
| DE | 2803763 | A1 | 1/1978 |
| DE | 102006008213 | A1 | 2/2006 |
| JP | 62087620 | A | 10/1985 |
| JP | 06306672 | A | 4/1993 |

OTHER PUBLICATIONS

Oberg, Erik et al.. "Machinery's Handbook and Guide to Machinery's Handbook", 2004, 27th Edition, pp. 417-419.*

* cited by examiner

*Primary Examiner* — Mickey Yu
*Assistant Examiner* — Robert J Hicks
(74) *Attorney, Agent, or Firm* — Kirton & McConkie; Evan R. Witt

(57) ABSTRACT

A metal fitting finding particular application as a corner fitting for an ISO freight container. The corner fitting is preferably cuboidal and comprises walls formed from a first material that define an internal cavity. At least one support member is encapsulated within the walls and is formed from a different material to that of the walls and comprises a greater yield strength. A reinforced corner fitting is therefore provided comprising enhanced load bearing capacity.

12 Claims, 4 Drawing Sheets

REINFORCED METAL CASTING

The present invention relates to a metal casting formed from a first metal material wherein a second metal material is encapsulated within the casting to increase the mechanical yield strength.

The present invention finds particular application for use a corner fitting for a freight, alternatively termed a shipping, container. Freight containers are widely used to transport goods over land, by air or sea. A typical container is generally cuboidal with doors at one face to provide access to the container interior for goods storage and removal.

During transportation, particularly by sea, the containers are stacked one on top of another and side by said to form high columns within a ship's hull. Conventional containers typically have corner fittings which are adapted specifically to allow the containers to be lifted by ship or dockside cranes, stacked and secured on top of one another in addition to the securement of stabilising rods to one or more sides of the container to increase the vertical stability of the container columns during transportation. The corner fittings are therefore required to bear significant loads, particularly where large numbers of containers are stacked vertically.

Where weight is a critical factor, containers are produced in aluminium. The container end fittings are typically cuboidal hollow structures and manufactured from cast aluminium so as to be resistant to corrosion whilst providing reasonable load bearing strength.

Due to the increased demand for transportation of goods and accordingly the need to increase the efficiency of goods transportation, the inventors have realised a requirement for an improved load bearing fitting, suitable for use with a shipping container configured to withstand greater load bearing forces so as to, in turn, both increase the operational longevity of the container and allow a greater number of containers to be stacked securely. Accordingly, this capability would enable a reduction in floor space required both during storage and transportation.

According to a first aspect of the present invention there is provided a metal fitting comprising: a cast body formed from a first metal material; and at least one support member formed from a second metal material having a higher yield strength than the first metal material, the at least one support member encapsulated within the cast body to increase the load bearing capability of the fitting.

Preferably, the first metal material (casting body) comprises aluminium or an aluminium based alloy. The second metal material (support member) preferably comprises any non-ferrous material having physical and mechanical properties to provide a higher yield strength than the first metal material. In particular, the second metal material may comprise appropriate physical and mechanical properties to enable a convenient casting operation involving elevated casting temperatures as the solid phase support member is encapsulated within the first metal material during casting. Accordingly, the second metal material is configured to maintain its solid phase whilst cast and encapsulated within the first material.

Preferably, the cast body comprises a three dimensional configuration having a plurality of faces, edges and vertices.

Preferably, and specifically for use with shipping or freight containers, the cast body is preferably a hollow cuboid with at least one face and preferably three faces comprising an aperture providing access to the internal cavity of the three dimensional body.

Preferably, the at least one support member is formed as bars or rods and positioned towards one or more edges of the three dimensional body. In particular, where the body is cuboidal a rod or bar may be positioned so as to extend within the wall of the hollow body aligned parallel and in close proximity to an edge.

In the preferred embodiment, the cast body comprises bars or rods extending internally within its walls extending parallel to three edges sharing a common vertex. Alternatively, the casting may comprise bars or rods extending along substantially the full length of each edge to provide a fully reinforced hollow cuboid structure.

The internally encapsulated bars or rods may be formed integrally or non-integrally with one another.

The bars or rods may comprise any cross-sectional configuration however, preferably the bars or rods comprise a circular, square or rectangular cross section.

Preferably, the at least one support member is encapsulated within the cast body such that the second metal material is totally encapsulated and not exposed at an external face regions of the cast body.

According to a second aspect of the present invention there is provided a freight container to transport cargo comprising a metal fitting positioned at each vertex of the freight container, the metal fitting comprising: a cast body formed from a first metal material; and at least one support member formed from a second metal material having a higher yield strength than the first metal material, the at least one support member encapsulated within the cast body to increase the load bearing capability of the fitting.

Accordingly to a third aspect of the present invention there is provided a method of casting a metal fitting comprising: casting a first metal material to form a cast body; and encapsulating a support member formed from a second metal material within the cast body as the first material is cast.

Preferably, the casting process comprises securing the second metal material (support member), in the solid phase, within a mould and introducing the first metal material into the mould in the liquid phase to encapsulate the second metal material.

According to an alternative casting processing, the cast body is formed by the first metal material. The cast body is then drilled to introduce elongate cavities within the cast body. The second metal material is then inserted into the as-formed cavities and is held in place by frictional contact forces with the cast body and/or additional means may be provided to secure the second metal material in position.

A specific implementation of the present invention according a preferred embodiment will now be described by way of example only and with reference to the accompanying drawings in which.

Figure 1:
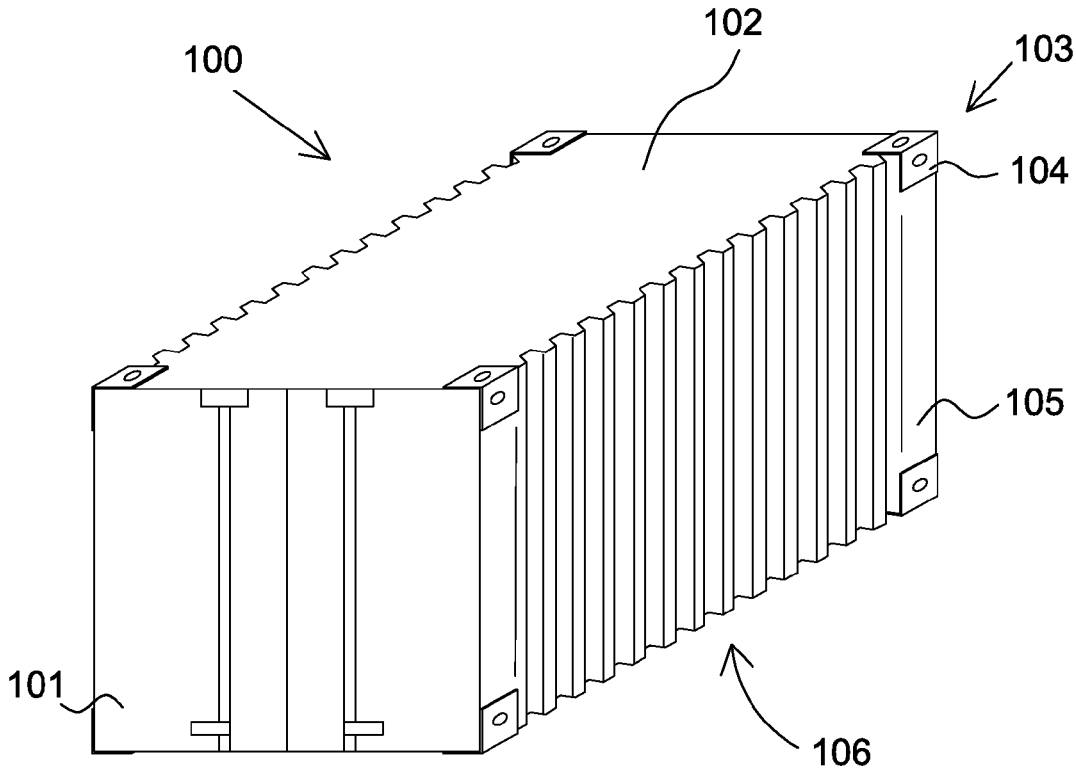
FIG. 1 illustrates an ISO freight container comprising metal cast corner fittings according to a specific implementation of the present invention.

FIG. 1 illustrates an ISO container 100 comprising a generally cuboidal configuration. The container 100 comprises a roof section 102, a floor section 106 and three wall sections 105 positioned between roof 102 and floor 106. One face of the cuboid comprises doors 101 allowing access to the interior of the container 100.

Each vertex 103 of container 100 comprises a corner fitting 104. Corner fitting 104 is configured to be load bearing such that a plurality of containers may be stacked on top of one another via these corner fittings 104.

Figure 2:
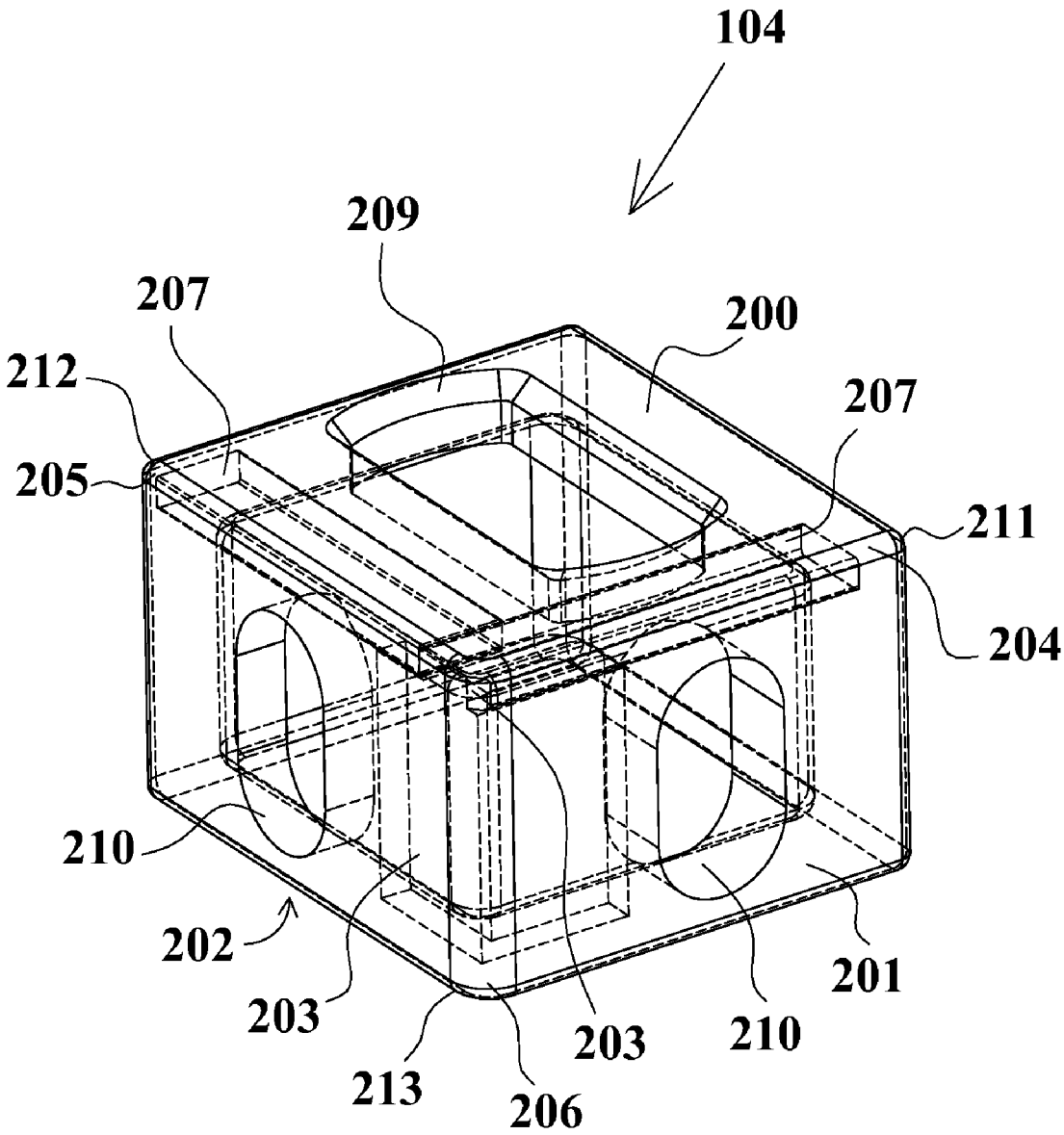
FIG. 2 illustrates a prospective view of one of the corner fittings as detailed in FIG. 1 according to a specific implementation of the present invention.
Figure 3:
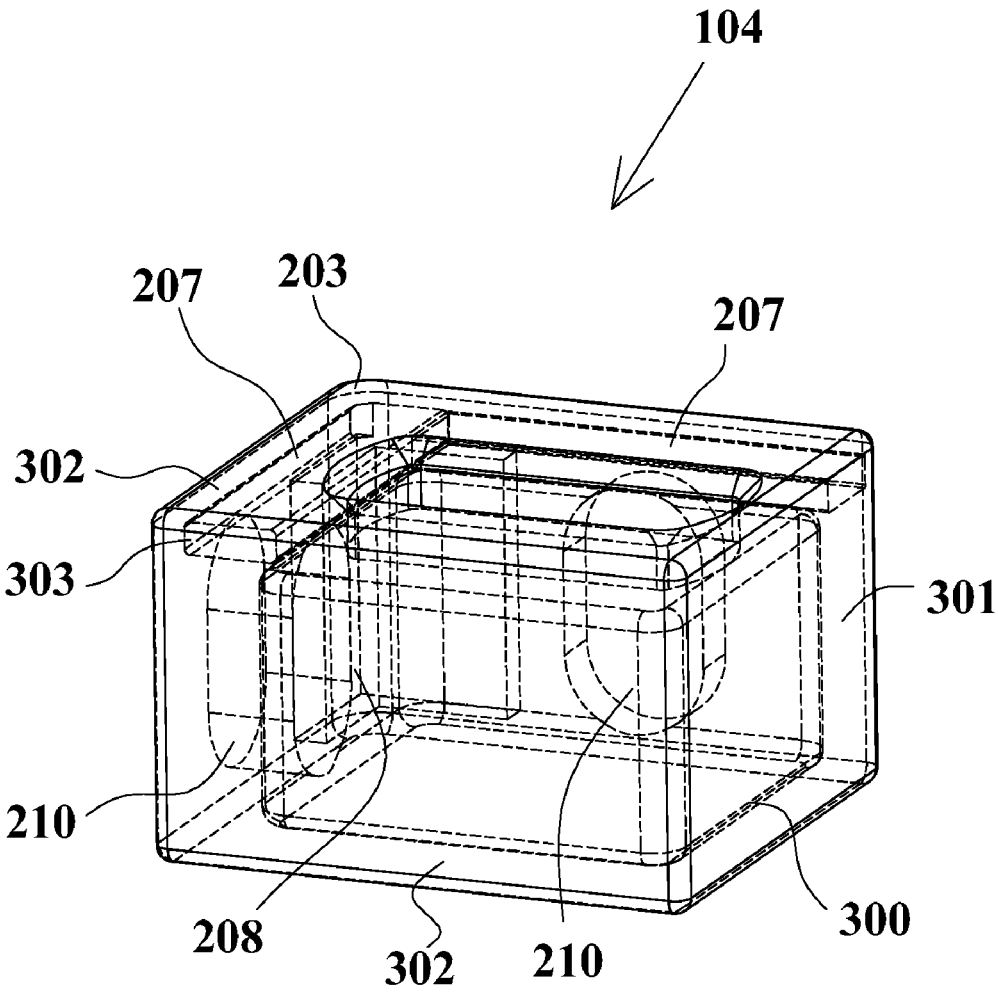
FIG. 3 illustrates a further prospective view of the corner fitting of FIG. 2.
Figure 4:
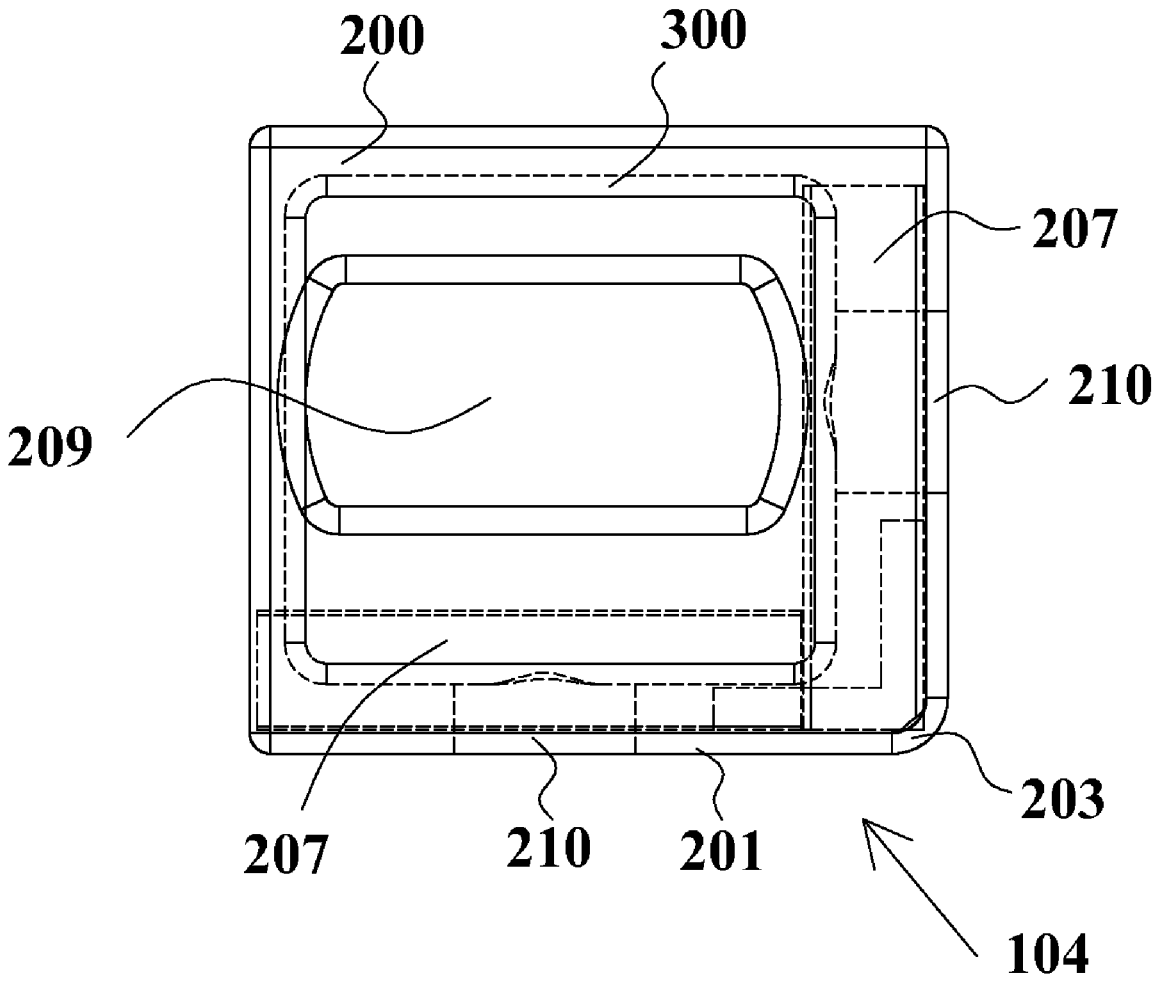
FIG. 4 illustrates a plan view of the corner fitting of FIG. 3.

Referring to FIGS. 2 to 4, the corner fitting of the subject invention is a metal cast formed as a rectangular cuboid having a top face 200, an opposed bottom face 202 and a plurality of side faces 201 extending between the top face 200 and bottom face 202. Two of the side faces 201 comprise apertures 210 formed therein and providing access to an internal cavity 300 defined by the side walls 301 and top and bottom walls 302. A third aperture 209 is formed in the upper face 200 also providing access into internal cavity 300.

Corner fitting 104 further comprises a plurality of reinforcing support members 207, 208 extending in three dimensions away from a common vertex 203. A first elongate reinforcement member 207, comprising a bar-like configuration extends from common vertex 203 towards a second vertex 211 and is aligned parallel to an edge 204 positioned between upper face 200 and side face 201. A second reinforcement member 207 extends from common vertex 203 to a third vertex 212 and is aligned parallel to a second edge 205.

A third support member 208 extends substantially perpendicular to the first and second support members 207 between common vertex 203 and a fourth vertex 213. Third support member 208 is aligned substantially parallel with a third edge 206 extending from top face 203 to bottom face 202.

According to the specific implementation, each support member 207, 208 comprises a substantially rectangular cross section 303 and is entirely capsulated within the respective (301, 302) wall section of the corner fitting 104. That is, when freight container 100 is orientated during normal use the first and second support members 207 are aligned in a substantially horizontal plane within the uppermost wall 302. Accordingly, the third support member 208 is entirely encapsulated within two of the side walls 301 extending between the upper and lower faces 200, 202 and is aligned in a substantially vertical plane.

According to a preferred method of casting the fitting 100, the support members 207, 208 are retained in a suitable mould whilst the fluid casting material is introduced so as to entirely encapsulate the support members 207, 208 during the casting operation. Once the casting material has solidified the support members 207, 208 form an integral component of the corner fitting 104 and are not visible at any one of the external surfaces 200, 201, 202.

According to an alternative method of manufacture, corner fitting 104 may be formed without the support members 207, 208 in position during the molten casting phase. The resulting cast is then drilled to create cavities within the respective walls 301, 302. The elongate support members 207, 208 are then introduced into the bore holes according to the orientation and configuration of FIGS. 3 to 4.

According to the preferred specific implementation of the present invention, the casting material that forms side walls 301, 302 is aluminium or an aluminium based alloy. The support members 207, 208 comprise a material having a higher yield strength than the casting material 301, 302 and are preferably a non-ferrous metallic material.

Further specific implementations of the present invention may comprise support members 207, 208 extending between all vertices of cuboidal corner fitting 104, where each support member 207, 208 is aligned substantially parallel with a respective edge. This would provide a fully reinforced casting. As will be appreciated by those skilled in the art, the metal corner fitting 104 may comprise any number of internal structural support members 207, 208 so as to provide a resultant structure of required physical and mechanical integrity with regard to load bearing capacity.

The invention claimed is:

1. A freight container metal corner fitting comprising:

a hollow cast body formed from a first metal material having walls that define an internal cavity region of the corner fitting;

three apertures extending through three respective walls of the cast body, each aperture allowing access into the internal cavity; and at least one support member formed from a second metal material having a higher yield strength than the first metal material, the at least one support member encapsulated entirely and extending within at least one wall of the cast body to increase a load bearing capability of the fitting.

2. The fitting as claimed as claimed in claim 1 wherein the first metal material comprises aluminum.

3. The fitting as claimed in claim 1 wherein the second metal material comprises a non-ferrous metal material.

4. The fitting as claimed in claim 1 wherein the cast body comprises a three dimensional configuration having a plurality of faces, edges and vertices.

5. The fitting as claimed in claim 1 wherein the cast body is a hollow cuboid.

6. The fitting as claimed in claim 1 wherein the at least one support member is formed as a bar or rod.

7. The fitting as claimed in claim 6 wherein the cast body comprises a three dimensional configuration having a plurality of faces, edges and vertices and wherein at least one bar or rod is positioned towards at least one edge substantially between at least two vertices.

8. The fitting as claimed in claim 7 wherein the cast body comprises three edges joined by a common vertex and at least one bar or rod extends substantially over the full length of said edge between said common vertex and a second vertex.

9. The fitting as claimed in claim 6 wherein said at lease one bar or rod comprise a rectangular cross section.

10. The fitting as claimed in claim 6 comprising a plurality of bars or rods are formed integrally with one another.

11. The fitting as claimed in claim 6 comprising a plurality of bars or rods formed non-integrally with one another.

12. A freight container to transport cargo comprising a metal fitting positioned at each vertex of the freight container, the metal fitting comprising:

a hollow cuboid cast body formed from a first metal material having walls that define an internal cavity region of the corner fitting;

three apertures extending through three respective walls of the cuboid cast body, each aperture allowing access into the internal cavity; and at least one support member formed from a second metal material having a higher yield strength than the first metal material, the at least one support member encapsulated entirely and extending within at least one wall of the cast body to increase a load bearing capability of the fitting.

* * * * *